United States Patent [19]

Malaval

[11] 3,972,370

[45] Aug. 3, 1976

[54] HOT SOURCE HAVING SLIGHT BULK

[76] Inventor: Claude Malaval, 39 rue des Coquelicots, 92160 Antony, France

[22] Filed: Oct. 25, 1974

[21] Appl. No.: 518,119

Related U.S. Application Data

[62] Division of Ser. No. 407,129, Oct. 17, 1973, Pat. No. 3,905,198.

[30] Foreign Application Priority Data

Oct. 19, 1972 France ..... 72.37041

[52] U.S. Cl. ..... 165/163; 165/166

[51] Int. Cl.[2] ..... F28D 9/04

[58] Field of Search ..... 165/163, 145, 164, 166

[56] References Cited

UNITED STATES PATENTS

| | | | |
|---|---|---|---|
| 1,110,065 | 9/1914 | Linga | 165/164 |
| 2,505,619 | 4/1950 | Holm | 165/166 X |
| 3,705,618 | 12/1972 | Jouet et al. | 165/166 |

FOREIGN PATENTS OR APPLICATIONS

| | | | |
|---|---|---|---|
| 1,396,469 | 3/1965 | France | 165/164 |

*Primary Examiner*—William E. Wayner
*Assistant Examiner*—William E. Tapolcai, Jr.
*Attorney, Agent, or Firm*—Sughrue, Rothwell, Mion, Zinn & Macpeak

[57] ABSTRACT

Hot source having slight bulk consisting essentially of a flattened tube commonly spirally wound on a central tube and in fluid communication therewith at the same time as a grating providing, for the flame of a burner, a passage between the turns of the tube. The assembly is placed in a cylindrical ferrule (hoopring).

3 Claims, 3 Drawing Figures

HOT SOURCE HAVING SLIGHT BULK

BACKGROUND OF THE INVENTION

FIELD OF THE INVENTION

The present application is a divisional application of the Application concerning "an improved rotary thermal engine", filed in the United States on Oct. 17, 1973 under the Ser. No. 407,129, now U.S. Pat. No. 3,905,198, claiming the priority of the French filing of Oct. 19, 1972.

PRIOR ART

It concerns, more particularly, a hot source having slight bulk, which may be used in a rotary engine in which a fluid flows in a closed circuit. That fluid is at least partly brought into contact with a hot source and a cold source in a cycle closely resembling the Stirling cycle.

In engines using hot fluid (gas or vapour) of the Stirling type, at present being developed with a view to replacing the internal combustion engine, one of the points which is the most delicate to solve is precisely the bulk both of the hot source and of the cold source when it is required to bring into effect the advantage afforded by the use of a large heat exchange surface.

Numerous attempts have been made to solve that problem.

More particularly, a bundle of tubes wound in a helical configuration has been used, but then a waste of space occurs, since there is a central portion which cannot be used.

The use of a bundle of parallel tubes whose ends are welded to perforated plates has also been proposed. However, this solution leads to great bulk and to the use of a considerable quantity of metal in the forming of the plates which must withstand the pressure applied. A device having great thermal inertia is then obtained and great mechanical stresses appear in the connections when the engine undergoes variations in operation rate.

To reduce the thermal inertia of his hot source, the inventor has used tubes made of thin sheet metal. To reduce the volume of the source, he has used very flat tubes wound in a spiral. The central space has been used to full advantage for constituting the central collector, whereas the outside collector has been formed by a split tube, two of whose generating lines are welded to the ends of the rolled tubes.

To enable such flat tubes made of thin sheet metal to withstand the pressures brought into play without undergoing any great deformation and to ensure between each element of the coil a passage having a constant cross-section for the hot gases of the flame constituting the hot source, the inventor has wound, at the same time as the pipes of the flat tubes, a grating made of crossed steel wires.

SUMMARY OF THE INVENTION

In this way, each hot source having slight bulk comprises a central tube welded along two flat generating lines, two flat tubes having thin walls commonly spirally wound around the central tube, maintained by spacers and arranged in a regular pitch and welded to two outside tubes and to an outside collar for holding the assembly rigid.

Indeed, the assembly thus formed of flat thin sheet metal tubes whose turns press against one another by means of a grid would have a tendency to unroll like the tube of a Bourdon gauge when it is subjected to pressure. That is why the inventor thought of avoiding that phenomenon by surrounding the assembly thus constituted by a collar for holding the assembly rigid. The result of this is that the said rigid collar undergoes the pressure efforts as a whole transmitted by the flat tubes and the gratings and acts like a cylindrical ferrule.

The efficiency of the cross-flux exchangers is less than that of parallel counter flow exchangers, because of the great variation in the difference of temperature of the fluids along the pipes. The disadvantage of this phenomenon has been limited by dividing the exchange surface into two or several windings connected "in series" by the central collector.

Therefore, the invention concerns a hot source having slight bulk comprising a central tube welded along two generating lines, two flat tubes having thin walls wound around themselves, maintained by spacers and arranged in a regular pitch and welded to two outsides tubes, and an outside collar for holding the assembly rigid.

In such a hot source, a metallic tape has been wound in a spiral in front of the spray nozzle of the burner. Heated by the radiation of the flame, that tape vaporizes, before the ignition, the drops of fuel coming from the spray nozzle according to a technique which is well-known in jet engines for preventing the sending out of carbon particles due to the cracking of the drops of fuel brought, in the flame, to too high a temperature. The inventor uses the same spirally wound tape at the starting up of the ending by making it red hot by Joule effect, this resulting in the igniting of the fuel.

A more detailed description of an example of embodiment is given herebelow with reference to:

FIG. 1, in which the heat source is shown in a sectional view;

FIG. 2, which is a side view;

FIG. 3, which shows in greater detail the elements shown already FIG. 1 and in FIG. 2.

Indeed, FIG. 3 shows in greater detail the winding of the flat tubes of the exchangers shown in a simplified way in FIGS. 1 and 2 corresponding to the description of the assembly comprising the engine which was the object of application Ser. No. 407,129, filed on Oct. 17, 1973, now U.S. Pat. No. 3,905,198, claiming the French priority of Oct. 19, 1972.

DESCRIPTION OF THE PREFERRED EMBODIMENT

Figure 1:
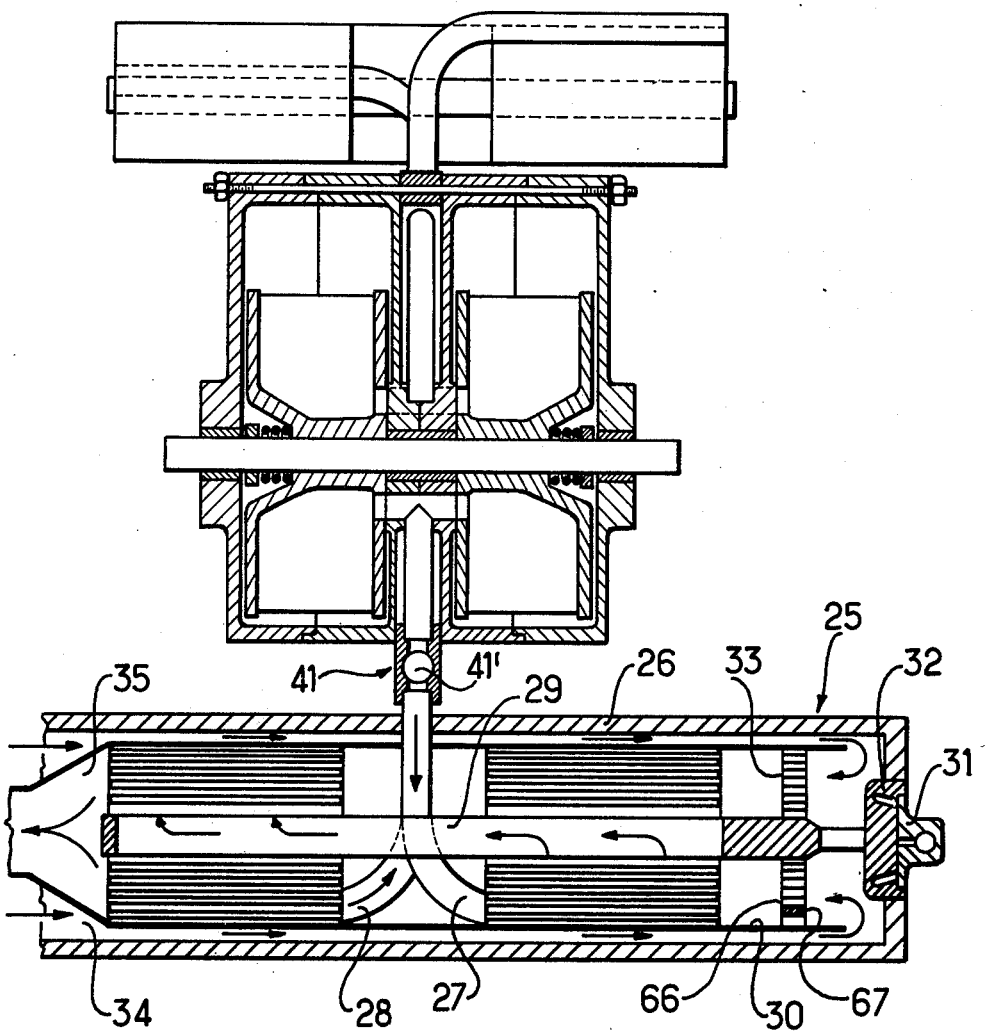
Figure 2:
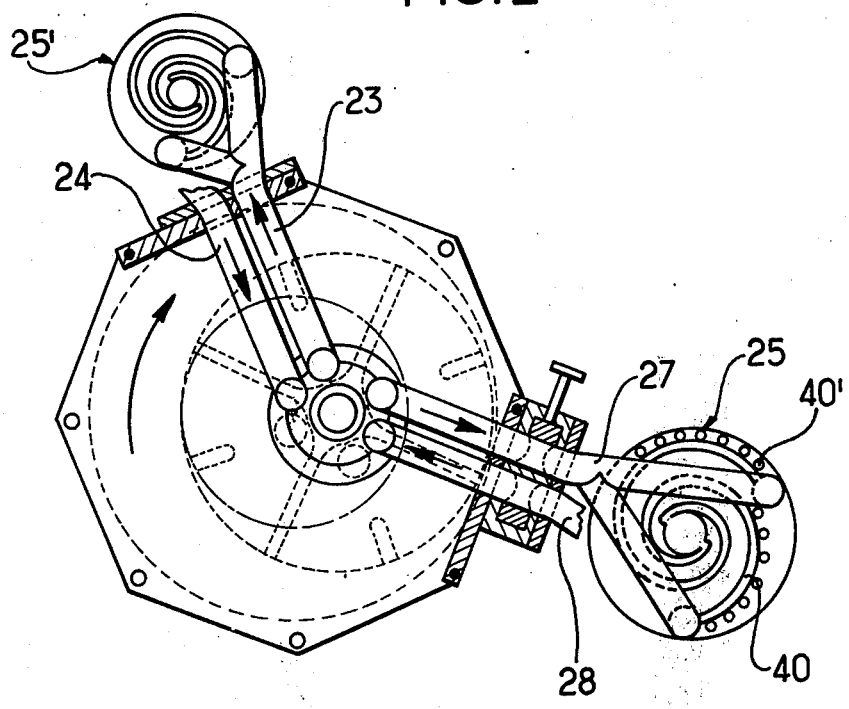
Figure 3:
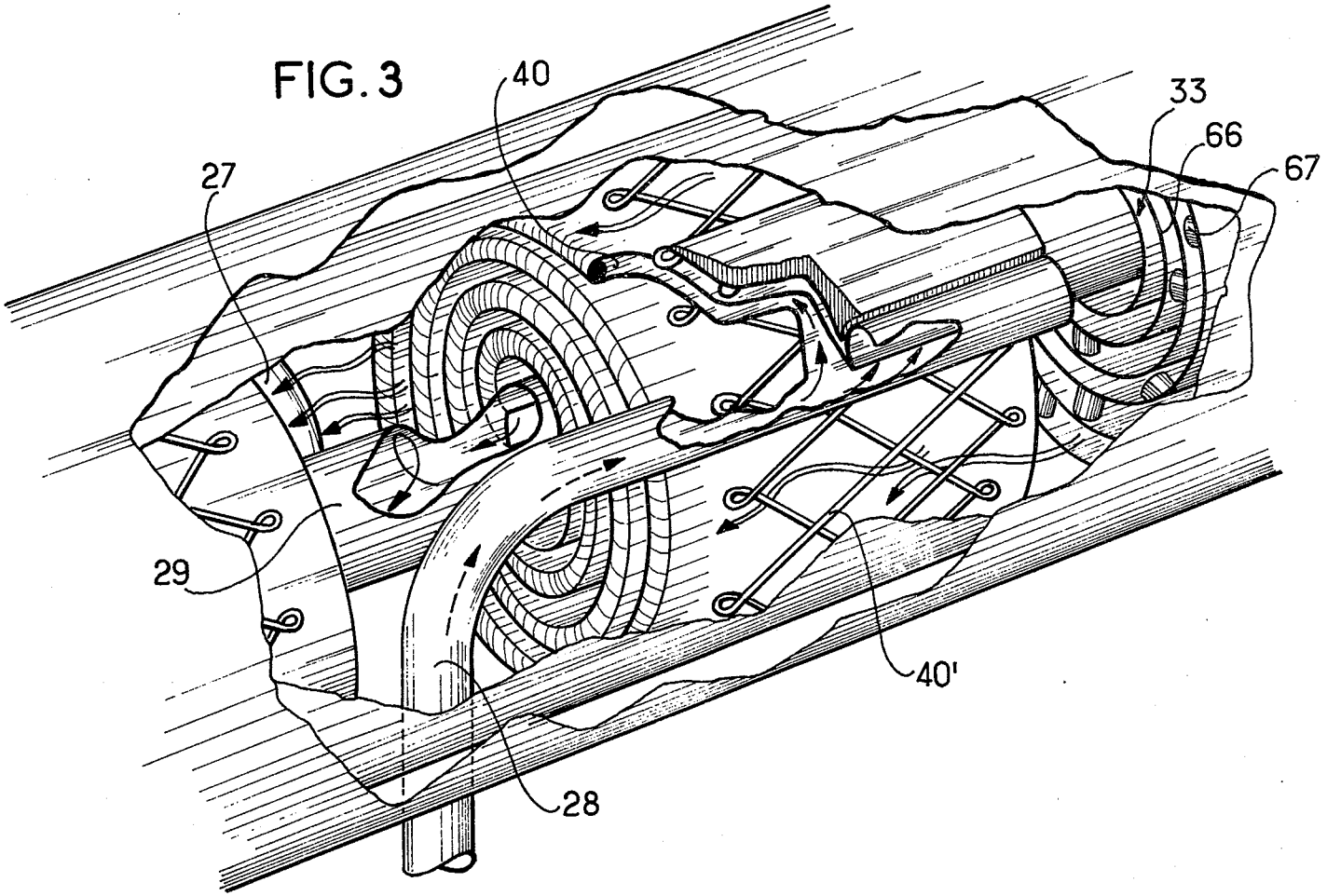

On referring to those figures, it will be seen that the communication of the engine with the hot source is provided for by two pipes making the chambers of the engine communicate with the hot source 25 by means of the tubes 27 and 28 extending respectively the said two pipes. In the hot source 25, the tubes 27 and 28 are welded along two generating lines to tubes 40 greatly flatteded and commonly wound in a spiral about the central tubing 29. Each flat tube 40 is reinforced by oblique steel wires 40' arranged in a regular pitch. These wires are fixed to the flat tubes 40.

The spiral of the flat tubes such as 40 is ended at the centre of the hot source in a central tubing 29 whence other flat tubes such as 40 wound in the reverse direction leave. The burner 31 is arranged at one end of the central tubing 29. The liquid fuel is sent by the sprayer 32 towards a heating grill 33 constituted by a metallic strip 66 insulated by ceramic elements 67.

That spiral coil is heated when the engine is started up by Joule effect by means of a storage cell battery (not shown). When the spiral winding has reached operating temperature, the spiral winding vapourizes the fuel. The air sucked in by the nozzle 34, flowing between the collar 30 and the casing 26 is heated and burns with the fuel. The combustion gases escape through the tubing 35 after having heated the drive fluid flowing in the flat tube 40.

The spiral of the flat tubes such as 40 is ended at the centre of the hot source in a central tubing 29 whence other flat tubes such as 40 wound in the reverse direction leave. The burner 31 is arranged at one end of the central tubing 29.

What is claimed is:

1. A heat exchanger having slight bulk comprising:

a central tube, a pair of thin wall flat tubes welded to said central tube in fluid communication therewith at circumferentially spaced locations and commonly spirally wrapped about said central tube, spacers interposed between said commonly spirally wrapped flat tubes to define a longitudinal flow path between said flat tubes for a first fluid in heat exchange with a second fluid flowing through said thin wall flat tubes, a pair of outside tubes, each outside tube being respectively welded to the radially outer end of one of said flat tubes and extending longitudinally parallel to said central tube, an outside tubular collar surrounding and confining an assembly formed by said spirally wrapped flat tubes, said spacers and said central tube and said two outside tubes and for rigidly holding said assembly and for limiting the longitudinal flow path of said first fluid outside of said flat tubes and about said spacer, and wherein said spacers comprise gratings in the form of steel wires spirally wound about said central tube between said thin wall spirally wound flat tubes.

2. The heat exchanger according to claim 1, wherein the outside collar is constituted by a circular ferrule.

3. The heat exchanger as claimed in claim 1, wherein said spirally wound wire includes integral oppositely inclined, overlapping wire portions in contact with opposed walls of adjacent turns of respective thin wall flat tubes.

* * * * *